United States Patent [19]

Bowers

[11] Patent Number: 4,912,949

[45] Date of Patent: Apr. 3, 1990

[54] LOCK CLAMP

[76] Inventor: Arvid M. Bowers, Rt. 2, Box 5146, Twin Falls, Id. 83301

[21] Appl. No.: 825,252

[22] Filed: Feb. 3, 1986

[51] Int. Cl.[4] ..... E05B 73/00; B25B 5/10

[52] U.S. Cl. ..... 70/19; 269/249

[58] Field of Search ..... 70/19, 61, DIG. 57, 70/183–185, 230, 232; 269/249

[56] References Cited

U.S. PATENT DOCUMENTS

| | | | |
|---|---|---|---|
| 1,072,559 | 9/1913 | Bacon | 70/19 |
| 1,408,652 | 3/1922 | Steinberg | 70/185 |
| 1,707,266 | 4/1929 | Hillborn | 70/19 |
| 1,875,734 | 9/1932 | Hurd | 70/19 |
| 1,991,208 | 2/1935 | Hawkins | 70/19 |
| 2,144,837 | 1/1939 | Douglas | 70/19 |
| 3,789,635 | 2/1974 | Van Brunt et al. | 70/232 |
| 3,910,079 | 10/1975 | Gassaway | 70/232 X |
| 3,913,880 | 10/1975 | Lucasey et al. | 70/232 X |
| 3,987,653 | 10/1976 | Lyon et al. | 70/19 |

FOREIGN PATENT DOCUMENTS

| | | | |
|---|---|---|---|
| 104606 | 8/1899 | Fed. Rep. of Germany | 70/185 |
| 965297 | 2/1950 | France | 70/232 |

*Primary Examiner*—Lloyd A. Gall

*Attorney, Agent, or Firm*—Paul F. Horton

[57] ABSTRACT

A lock clamp for locking a camper shell to a pickup box, said lock clamp having a substantially C-shaped clamp with a clamp screw for clamping the sill of a camper to the side rail of the pickup box and a lock, preferably of the tumbler type, said lock being integral with the clamp and including a lock screw operable to abut a planar surface on the clamp screw to prevent rotation thereof. The lock screw is rotated by a key which is insertable into the lock laterally for convenience and so as to displaced from the lock screw.

4 Claims, 2 Drawing Sheets

LOCK CLAMP

BACKGROUND OF THE INVENTION

1. Field of the Invention

This invention relates generally to clamps and locking devices, and more particularly to lock clamps operable to hold camper shells to pickup beds or to display racks to prevent theft or accidental removal of the shell.

2. Description of the Prior Art

Camper shells, mountable on pickup beds are very popular throughout the country. Pickup boxes are generally not equipped with fasteners for secure attachment of the shells and therefore shells are often simply placed on the pickup without proper attachment. Such shells are subject to being accidently blow from the pickup or being tossed from the pickup in case of accident. A further problem is theft of camper shells from the pickup or from display racks in sales lots.

It is therefore highly desirable to provide secure attachment of camper shells to either pickups or display racks with a minimum of effort. For convenience and for practicality, it is essential that the lock clamp be adjustable to varying thicknesses; that the lock clamp be tamper resistant; and that the lock be readily accessible to the user. No lock clamps are known which fulfill these requirements and hence the present invention.

U.S. Pat. No. 2,144,837 issued to J. L. Douglas discloses a clamp which includes a lock which rides on and engages the clamp screw, the lock being held to the clamp by means of an abutment finger. The Douglas clamp is not practical for attachment of a camper shell to a pickup box or display rack in that the lock is not integral with the clamp, thereby permitting easy severance between lock and clamp; in that there is interference between the clamp screw and the locking mechanism—the key being parallel and in close engagement with the screw; and in that when in place for vertical clamping the key hole is in a vertical position which renders the lock accessible to dust and debris or, in the alternative, makes the lock too inconvenient for normal use.

SUMMARY OF THE INVENTION

The present invention comprises, generally, a lock clamp which includes a C-shaped clamp; a clamp screw; and a tumbler type lock which is housed within the clamp and is therefore integral therewith; the lock being operable by a laterally inserted key which engages a lock screw which transversely abuts a planar side of the clamp screw to prevent rotation thereof to secure any workpiece clamped therein. A more detailed description of the invention may be found in the appended claims.

It is therefore a primary object of the present invention to provide a lock clamp which may be used to clamp the sill of a camper to the side rail of a pickup box.

More specifically, it is an object of the present invention to provide a lock clamp which is readily useable in the vertical clamping position by means of a laterally insertable key.

Another important object of the present invention is to provide a lock clamp in which the lock is housed within an arm of the clamp so as to be integral therewith to prevent severance of the lock from the clamp.

It is also an object of the present invention to provide a lock clamp wherein the lock includes a lock screw rotatable by a key to abut a clamp screw to prevent rotation of the clamp screw.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
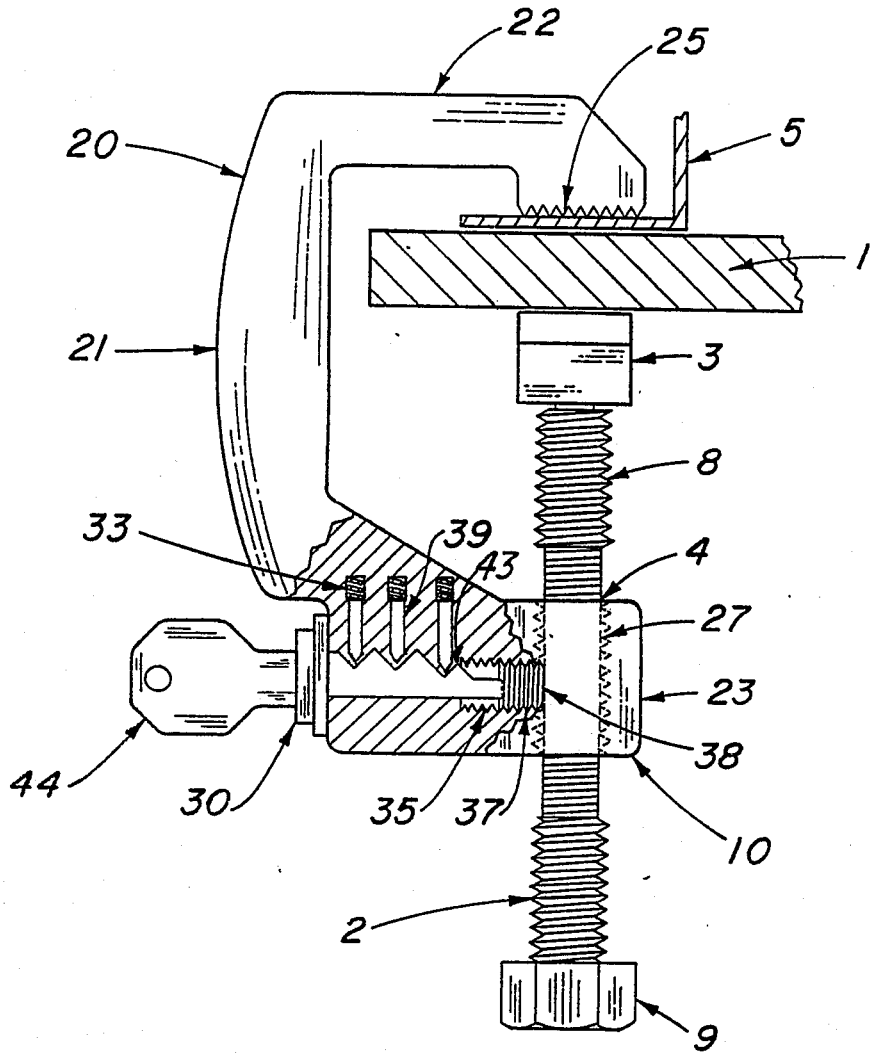
FIG. 1 is a side view in partial section of the lock clamp of the present invention shown clamping the sill of a camper to the side rail of a pickup box. The conventional lock tumblers and their relationship to the key being shown in schematic form.

Referring now to the drawings, an embodiment to be preferred of a lock clamp 10, made according to the present invention, is disclosed. Lock clamp 10 includes a substantially C-shaped clamp 20; a clamp screw 2; and lock means, designated generally by the numeral 30.

Clamp 20 includes a body portion 21 and a pair of vertically spaced, parallel arms, upper arm 22 and lower arm 23. The upper arm may include a downwardly depending jaw 25 for engagement of a workpiece 5. "Workpiece", as used herein, is broadly defined and includes any structure which may be clamped. The workpiece referred to as numeral five is, for example, the sill of a camper shell. The lower arm 23 defines a threaded aperture 27 for rotatably receiving clamp screw 2. Clamp screw 2 includes a polygonal head 9, a threaded shaft 8, and a workpiece contacting platform 3, which may pivotally engage shaft 8. Shaft 8 includes at least one, and preferably two, planar sides 4.

Figure 2:
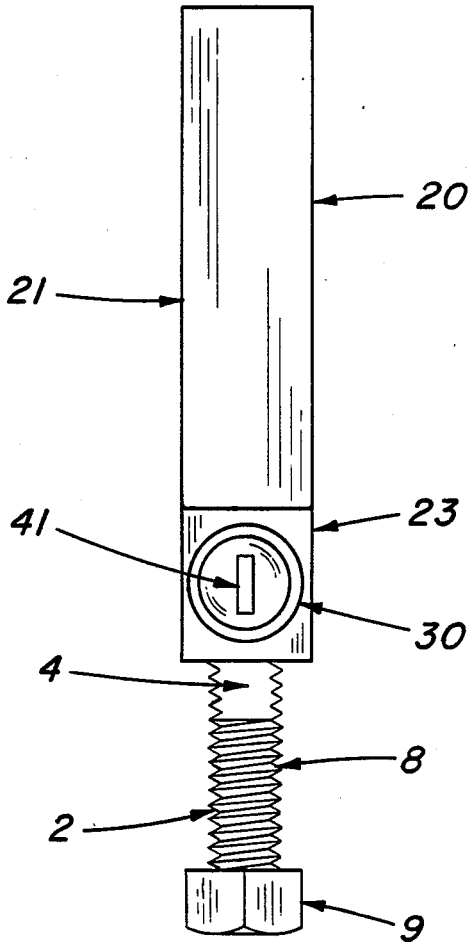
FIG. 2 is a back view of the clamp of FIG. 1.

Lock means 30 is preferably in the form of a tumbler type lock-key arrangement, as shown in FIG. 1. In that tumbler locks are conventional in the art, it is believed that a detailed description of such is unnecessary. Lock 33 utilizes lower arm 23 as its housing, so as to be integral with clamp 20 for convenience as well as for lock security. Lock 33 includes a threaded bore 35, disposed at a right angle to threaded aperture 27 and communicating therewith. Contained within bore 35 is a lock screw 37 having a planar end 38 which is operable to engage one of the planar sides 4 of clamp screw 2 to prevent rotation of the clamp screw. Lock screw 37 is rotated, through keyhole 41, shown in FIG. 2, by key 44 for contact or disengagement with clamp screw 2. A slot, not shown, in the end of the clamp screw opposite abutment end 38 may be used for engagement between the key and the lock screw. While the lock system may be of any conventional type, it is preferred that a plurality of tumblers 39 engage notches 43 of the key to prevent use of a non-conforming key. It is to be noted that the key extends rearwardly of lower arm 23 and below body portion 21 of clamp 20 so as to be readily viewable and available to the operator. It is to be further noted that the key and entrance to the lock is removed from the head 9 of clamp screw 2 for uninterrupted rotation of the screw in tightening or loosening the clamp relative to the workpieces 1 and 5.

For operation, and assuming the workpieces involved in the clamping action are sill 5 of a camper shell and a side rail 1 of a pickup box, the operator places jaw 25 of clamp 20 on sill 5 and tightens clamp screw 2, bringing platform 3 of the screw into contact with the lower surface of side rail 1 of the pickup box. A wrench may be used to tighten the clamp screw without interference with the locking mechanism. Once tightened securely and with the clamp screw presenting one of its planar sides 4 to lock screw 37, the lock screw is then tightened by key 44 with end 38 of the screw abutting side 4 of the clamp screw. In this manner, sill 5 of the camper shell is held firmly against the side rail of the pickup box, or against a rail of the display rack, as the case may be. Key 44 is then removed and the camper shell cannot be removed without loosening of the clamp by means of the key.

Having thus described in detail a preferred embodiment of the present invention, it is to be appreciated and will be apparent to those skilled in the art that other physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A lock clamp comprising:

a substantially C-shaped clamp having a body portion, an upper arm, and a vertically spaced lower arm, said upper arm provided with a workpiece engagement means and said lower arm provided with a vertical threaded aperture;

a clamp screw threadably and rotatably engaging said threaded aperture, said clamp screw provided on its shaft with at least one planar side portion; and lock means, said lock means including a housing lock and key, said lock affixed to said lower arm of said clamp, said lock including a threaded bore transversely disposed to said threaded aperture of said clamp, a threaded lock screw rotatably engaging said lock bore, said lock screw provided with a planar end for engaging one of said planar side portions of said clamp screw and said lock screw provided with key engagement means whereby said lock screw may be rotated by said key upon insertion of said key into the lock to cause abutment between the planar surfaces of said lock screw and said clamp screw to prevent rotation of said clamp screw upon removal of said key and to thereby prevent removal of the lock clamp from a workpiece.

2. The lock clamp as described in claim 1 wherein said lock of said lock means includes a plurality of tumblers, each tumbler operable to engage a portion of said key for compatibility only with keys of like configuration.

3. The lock clamp as described in claim 1 wherein said key is insertable in alignment with said lock screw.

4. The lock clamp as described in claim 1 wherein said housing lock is integral with said lower arm of said clamp.

* * * * *